US006175967B1

(12) United States Patent
Donzis

(10) Patent No.: US 6,175,967 B1
(45) Date of Patent: Jan. 23, 2001

(54) AIR FIT PROTECTIVE SYSTEM

(76) Inventor: Byron A. Donzis, #18 W. Rivercrest, Houston, TX (US) 77042

( * ) Notice: Under 35 U.S.C. 154(b), the term of this patent shall be extended for 0 days.

(21) Appl. No.: 09/456,215

(22) Filed: Dec. 7, 1999

Related U.S. Application Data

(63) Continuation of application No. 08/597,564, filed on Feb. 2, 1996, now abandoned.

(51) Int. Cl.[7] ..... A42B 3/00
(52) U.S. Cl. ..... 2/413; 2/44
(58) Field of Search ..... 2/2, DIG. 3, 413, 2/411, 44, 45

(56) References Cited

U.S. PATENT DOCUMENTS 3,849,801 * 11/1974 Holt et al. ..... 2/413
3,855,631 * 12/1974 Ettinger ..... 2/2
3,866,243 * 2/1975 Morgan ..... 2/413
3,999,220 * 12/1976 Keltner ..... 2/413
4,370,754 * 2/1983 Donzis ..... 2/2
4,685,151 * 8/1987 Kincheloe ..... 2/2
5,263,203 * 11/1993 Kraemer ..... 2/DIG. 3
5,390,367 * 2/1995 Rush, III ..... 2/DIG. 3
5,458,516 * 10/1995 Uglene et al. ..... 2/DIG. 3
5,546,602 * 8/1996 Hale ..... 2/DIG. 3

* cited by examiner

*Primary Examiner*—Bibhu Mohanty
(74) *Attorney, Agent, or Firm*—Felsman, Bradley, Vaden, Gunter & Dillon, LLP; Sue Z. Shaper

(57) ABSTRACT

An improved impact absorbing composite comprising protective gear including a shell and a protective layer and a fitting pad comprising a substantially air-tight foam-filled enclosure attached to the protective gear and providing means for adjusting the internal pressure of the enclosure.

18 Claims, 4 Drawing Sheets

FIG. 4
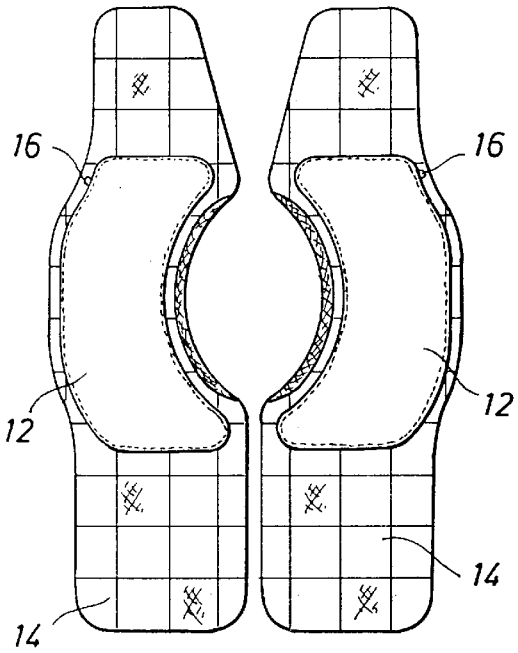
FIG. 5
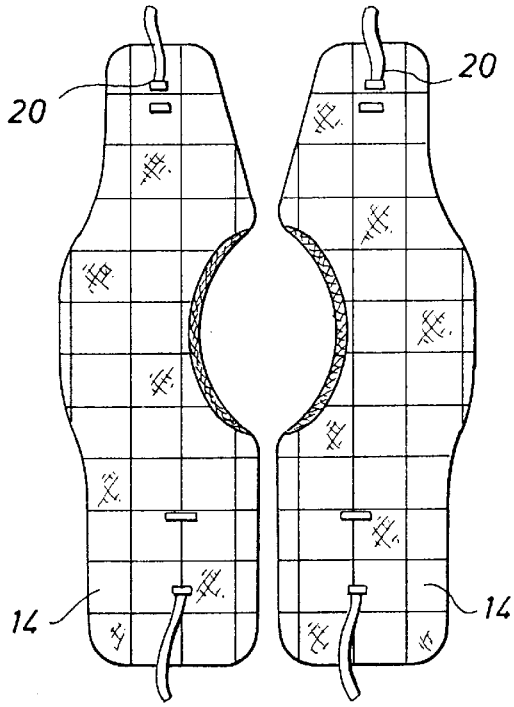
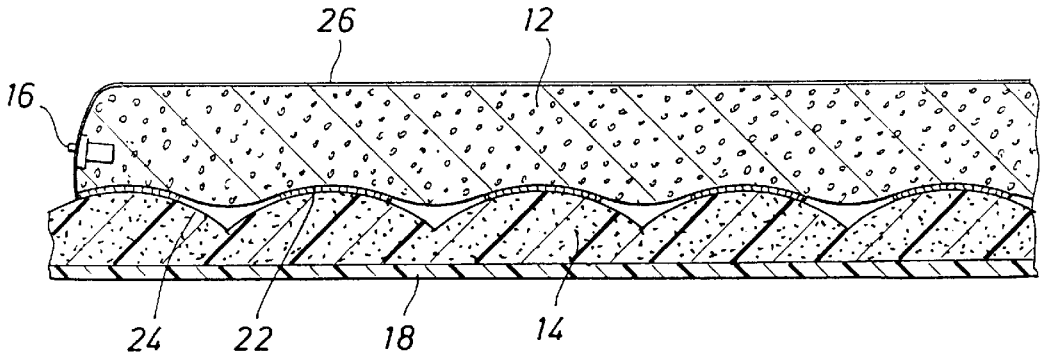
FIG. 6
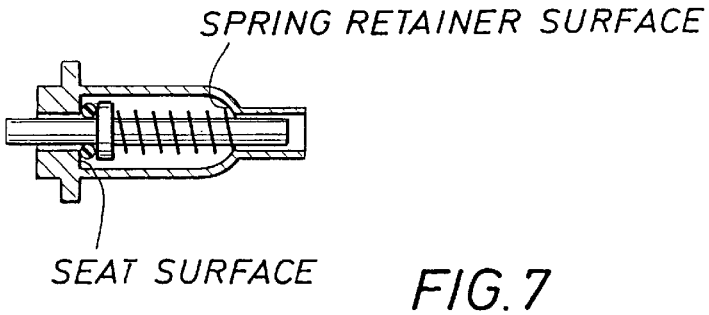
FIG. 7

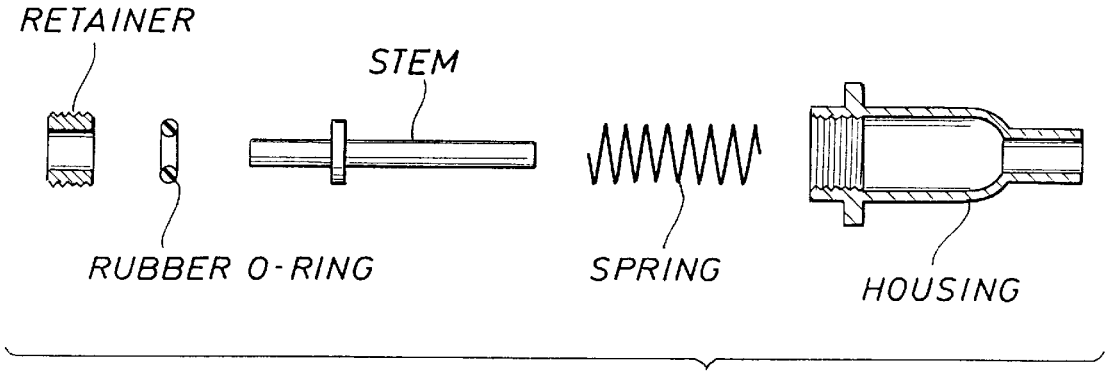
FIG. 8
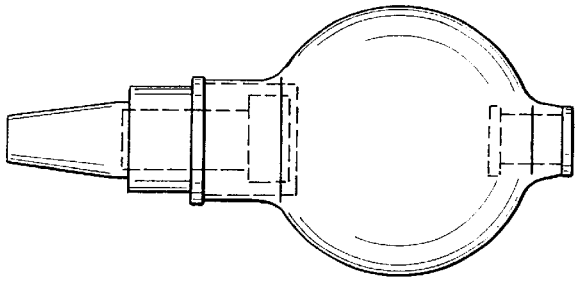
FIG. 9
FIG. 10
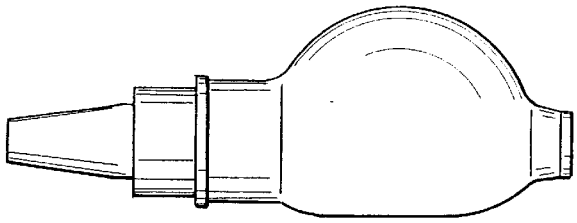
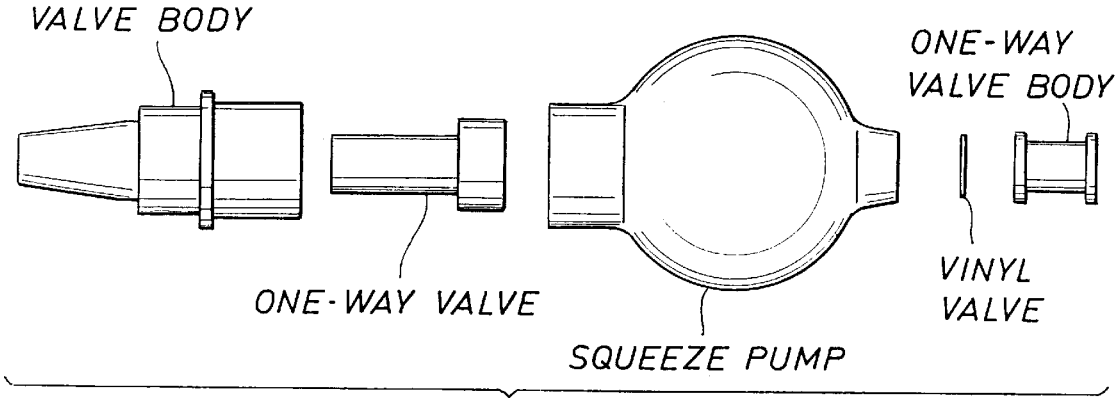
FIG. 11

FIG. 12
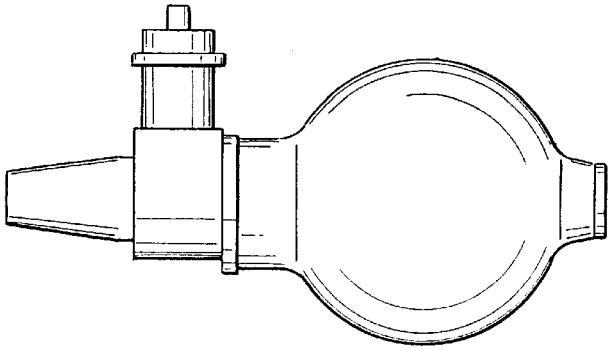
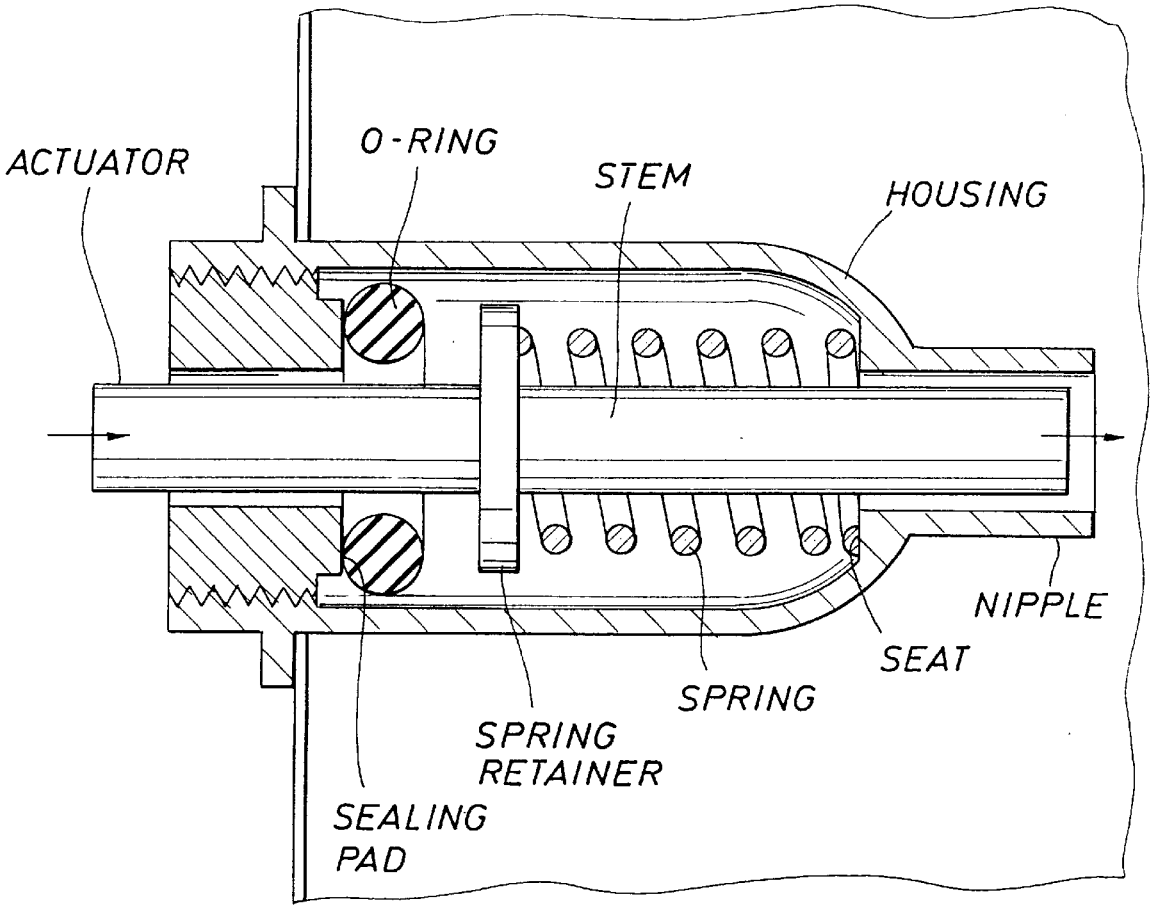
FIG. 13

AIR FIT PROTECTIVE SYSTEM

This is a Continuation patent application of application Ser. No. 08/597,564 filed on Feb. 2, 1996 now abandoned.

BACKGROUND OF INVENTION

1. Field of Invention

The subject invention is generally related to impact absorbing equipment and is specifically directed to an improved impact absorbing system for protective gear including a fitting pad attached to an impact absorbing layer worn under a protective shell for providing protective equipment contoured to custom fit each individual.

2. Description of the Prior Art

The primary goal of the protective equipment is to protect the wearer, usually a person but possibly an animal or an inanimate object, against injury or against aggravation of a previous injury. Protective athletic equipment, such as shoulder pads, rib protectors and hip or thigh pads, are commonly worn by participants in many types of sports for protection from shock resulting from forceful contact with the ground or another participant.

Typically, protective "pads" include both an impact absorbing cushion layer and an overlying shell or shield constructed of a lightweight material such as molded plastic to provide means for dispersing the impact of an external force so that it may be more uniformly absorbed by the underlying cushion over a broad ares.

A common problem with protective gear is that it is bulky and often uncomfortable. An uncomfortable protective pad may interfere with a wearer's performance. Although it is possible to modify and mold protective pads to provide a better fit, this may significantly increase the cost of the pads, may significantly increase the overall weight, thickness or flexibility of the pads, and may sacrifice impact absorbing capability.

While pads commonly available are designed to optimally protect against impacts, they are not designed to fit the individual shape of each wearer. It is an object of the present invention to provide protective gear that is comfortable and avoids the disadvantages of a protective pad that does not fit well. There is need for an improved impact absorbing system which includes means for shaping the gear to more properly fit individual wearers for maximum comfort and protection, without significantly increasing the overall weight, thickness, flexibility or cost of the pads, and without sacrificing protection.

SUMMARY OF THE INVENTION

The subject invention is directed to an improved impact absorbing system including protective gear comprising a shell overlaying an impact absorbing layer and a fitting pad including a substantially air tight enclosure, attached or attachable to the protective layer, for providing an impact absorbing system contoured to form a comfortable fit against an individual body. The fitting pad enclosure is formed of a generally air impermeable stretch material enclosing a foam core and includes means for adjusting the internal pressure of the enclosure. The adjusting means may include a release valve which permits air to enter or leave when depressed and/or may include a combination of a release valve and pump valve for adjusting the internal pressure of the enclosure.

In use, the fitting pad enclosure is preferably releasably attached to the protective pad layer, such as by a hook and loop-type attachment, and is worn against the body. After the impact absorbing gear is in place, air is added or released from the fitting enclosure through the release and inflate valve or valves so that the enclosure may be adjustably shaped against a body to form a comfortable fit. The fitting enclosure may include a dual valve and a self-inflating foam for reinflating the enclosure to its original form. Alternatively, the fitting enclosure may include a pump, housed either separately or in combination with a release valve, for re-inflating the enclosure, as desired.

Therefore, it is an object and feature of the subject invention to provide an impact absorbing system contoured to form a comfortable fit against an individual body.

It is another object and feature of the subject invention to provide an impact absorbing system including a shell overlaying an impact absorbing protective pad layer and a substantially air tight fitting enclosure attached to the protective pad layer.

It is an additional object and feature of the subject invention to provide a fitting enclosure formed of a generally air impermeable stretch material enclosing a foam core and including a means for adjusting the internal pressure of the enclosure.

It is another object and feature of the subject invention to provide a fitting enclosure which is releasably attached to the protective pad layer.

It is yet another object and feature of the subject invention to provide a fitting enclosure including an adjusting means including a release valve for permitting air to enter or leave the enclosure so that the enclosure may be adjustably shaped against the body to form a comfortable fit.

Other objects and features will be readily apparent from the accompanying drawings and description.

BRIEF DESCRIPTION OF THE DRAWINGS

A better understanding of the present invention can be obtained when the following detailed description of the preferred embodiment is considered in conjunction with the following drawings, in which:

FIG. 4 is a perspective view of the body side of the improved impact absorbing system showing the location of the fitting enclosure against the body, the protective pad layer and the location of the release valve.

FIG. 5 is a perspective view of the shell side of the improved impact absorbing system showing the hard plastic shell and an attaching strap.

FIG. 6 is an enlarged cross-sectional view of the improved impact absorbing system including a hard plastic shell overlaying a quilted protective pad layer including a hook and loop-type fastener and overlaying a fitting enclosure including a release valve and a hook and loop-type fastener for attaching the fitting enclosure to the protective pad layer.

FIG. 7 is an enlarged side view of an air release valve illustrating the components of the valve in the housing.

FIG. 8 is an enlarged exploded view of the air release valve showing each of the components of the valve including the housing, a stem, spring, spring seat an rubber O-ring, and an actuator for releasing air through the valve.

FIG. 9 is an enlarged top view of a pump valve illustrating the components of the pump valve.

FIG. 10 is a side of the pump valve.

FIG. 11 is an enlarged, exploded view of the pump valve showing each of the components of the valve.

FIG. 12 is a side view of a pump and release valve contained in one unit.

FIG. 13 is a view of the air release valve.

DETAILED DESCRIPTION OF THE DRAWINGS

Figure 1:
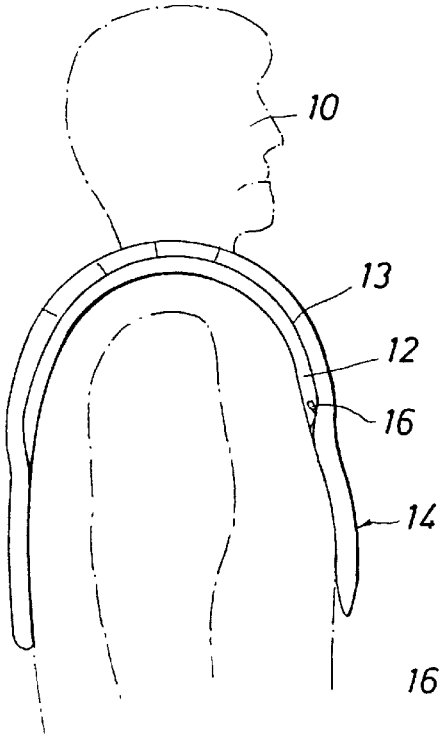
FIG. 1 is a side perspective view of an improved impact absorbing system in shoulder protective equipment worn by an individual including a protective pad layer overlaying a fitting enclosure having a release valve.

The improved impact absorbing composite of the present invention is illustrated in the drawings in the form of football shoulder pads. A primary application of the improved protective gear lies in sports, and in particular, in football. The invention is also applicable, however, to other sports as well as to protective gear for animals, such as horses. The invention is even applicable to protective gear for inanimate objects, such as a computer.

Figure 2:
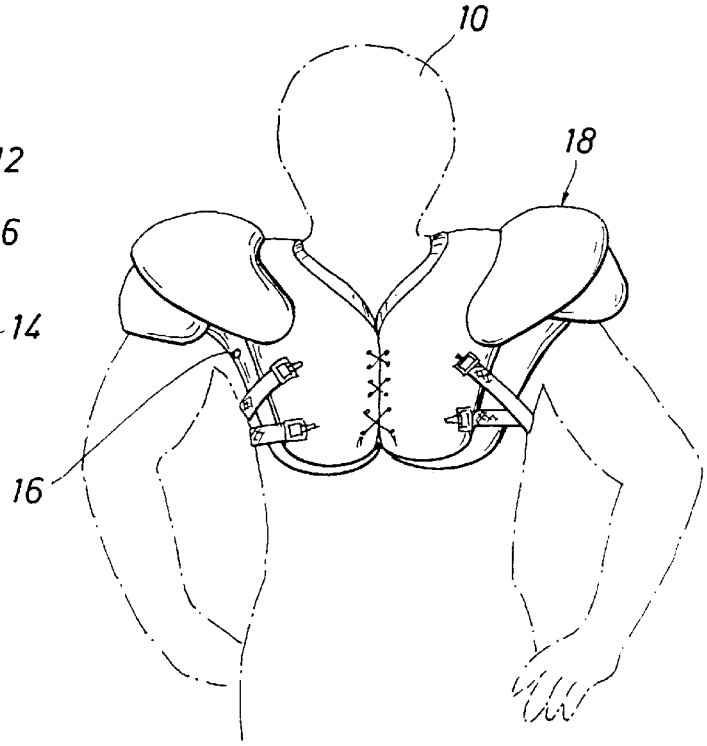
FIG. 2 is a front perspective view of the improved impact absorbing system in shoulder protective equipment worn by an individual showing the hard plastic shell overlaying the protective pad layer and the location of the release valve.
Figure 3:
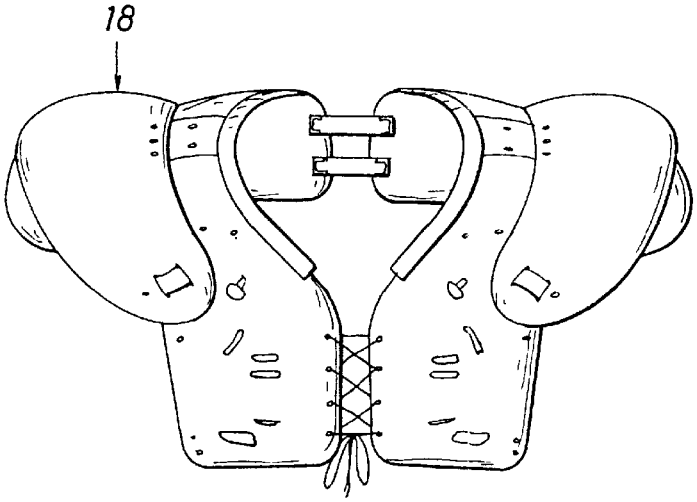
FIG. 3 is a front perspective view of the improved impact absorbing system in shoulder protective equipment.

FIG. 1 shows a side perspective view of an improved impact absorbing system according to the present invention comprising shoulder pad protective equipment. This is equipment to be worn by an individual in a sport such as football. FIG. 1 shows individual 10 wearing protective gear comprising fitting pad 12 next to the body. Attached to fitting pad 12 is valve 16. Valve 16 is attached at a location where the valve is unlikely to injure the wearer during impact. Overlaying fitting pad 12 is protective layer 14. In the embodiment of FIG. 1 fitting pad 12 contains foam within an air tight enclosure material 13 as does protective layer 14. FIGS. 2 and 3 show hard shell 18 designed to overlay protective layer 14 in the protective gear composite.

Figure 1A:
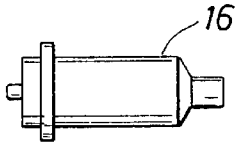

FIG. 1*a* illustrates one type of valve 16 available that could be incorporated into the protective gear. Valve 16 and/or an optional pump could be placed in any location suitable for convenience and that would prevent injury during impact. FIG. 3 further illustrates the make-up of shell 18 for the protective gear. Typically shell 18 is comprised of a hard plastic material.

FIG. 4 offers an underside view of the protective gear of the type of FIGS. 1 through 3. FIG. 4 illustrates how fitting pad 12 fits and attaches under protective layer 14. FIG. 5 illustrates protective layer 14 showing attaching straps 20 wherein layer 14 may be attached to shell 18.

FIG. 6 offers an enlarged cross-sectional view of the improved impact absorbing system including hard plastic shell 18 overlaying a quilted protective pad layer 14 and including a hook and loop type fastener 22 for attaching fitting pad enclosure 12 to the protective gear. FIG. 6 further illustrates the use of an air impervious stretch material 26 as enclosure material for fitting pad 12. FIG. 6 also illustrates the use of a quilted air impervious stretch material 24 as enclosure material for protective layer 14. The air impervious stretch material might comprise a lycra-type fabric having stretch threads and a rubber or vinyl finish on one side. The quilting and protective layer 14 might be achieved by sewing or heat sealing.

FIGS. 7 through 13 illustrate various valve and pump means for adjusting air within fitting pad 12. The valves and pumps of FIGS. 7 through 13 are known in the art. FIG. 12 illustrates a pump and release valve combination in one unit, as is known in the art. FIGS. 9, 10 and 11 offer an enlarged exploded view of a pump valve illustrating typical components of the valve. FIGS. 7 and 8 illustrate an air release valve showing the components of such valve.

In operation, the fitting pad 12 is attached to protective layer 14 of the protective gear, if the fitting pad enclosure is not already attached. The fitting pad may be provided with releasable attaching means, such as hook and loop means, if desired.

The gear is then placed on a body or individual to wear the gear. In one methodology the fitting pad enclosure is first over inflated. Then air is controllably released through a release valve attached to the fitting pad enclosure until the protective gear assumes a comfortable fit on the body.

Alternately, the fitting pad enclosure may be depressed, deflating the enclosure and foam cone within. Subsequently an air release valve can be opened. The compressed foam forming the interior core of the fitting pad begins to expand. As it expands, air is permitted to enter the fitting pad enclosure through the depressed release valve. The release valve is closed when the foam has expanded to a comfortable position on the wearer.

A squeeze pump may be incorporated and attached to the fitting pad enclosure, either separate from or incorporated together with a release valve. Such onboard pump permits the wearer to inflate the pad while in use.

While specific embodiments and features of the invention have been disclosed herein, it will be readily understood that the invention encompasses all enhancements and modifications within the scope and spirit of the following claims.

What is claimed is:

1. An improved impact absorbing pad designed to be worn on a body, comprising:

protective gear including a shell attached to an impact absorbing layer; and a fitting pad, distinct from said impact absorbing layer, comprising a substantially air tight air-filled and foam-filled enclosure attached to the underside of the protective gear, the enclosure formed of a generally air impermeable material enclosing a foam core, the fitting pad having means attached for adjusting the internal air pressure of the enclosure while the gear and fitting pad are worn on a body.

2. The pad of claim 1, wherein the impact absorbing layer comprises foam attached to a generally air impermeable, stretchable material, the material enclosing the fitting pad core comprises stretch material; and wherein the shell comprises hard plastic.

3. The pad of claim 2, wherein the impact absorbing layer is quilted.

4. The pad of claim 2, wherein the generally air impermeable stretchable material comprises a lycra fabric overlaying and attached to the foam.

5. The pad of claim 1, further comprising means for releasably attaching the fitting pad to the protective gear.

6. The pad of claim 5, wherein said means for releasably attaching comprise a hook and loop type attachment.

7. The pad of claim 1, wherein the foam filling of the fitting pad includes multiple density foams.

8. The pad of claim 1, wherein the foam filling of the fitting pad is adhered to the pad enclosure walls.

9. The pad of claim 1, wherein the pressure adjusting means comprises a release valve permitting air to enter or leave when depressed.

10. The pad of claim 1, wherein the pressure adjusting means includes a release valve and a pump valve.

11. The pad of claim 10, wherein the release valve and the pump valve are housed in one unit.

12. The pad of claim 10, wherein the release valve and the pump valve are housed in separate units.

13. A method for protecting against impact, comprising the steps of:

on a body, placing protective gear having a shell attached to an impact absorbing layer;

placing between the protective gear and the body an air-filled fitting pad having a substantially air-tight enclosure surrounding a foam core; and adjusting air pressure in said enclosure to fit the enclosure shape to contours of the body subsequent to placing the protective gear on the body while the gear remains on the body.

14. The method of claim 3 wherein said step of adjusting a fluid level includes inflating said enclosure and deflating said enclosure.

15. The method of claim 3 wherein said step of placing a fitting pad includes releasably attaching said fitting pad to said protective gear.

16. The method of claim 3 wherein the step of adjusting a fluid level includes inflating the fitting pad enclosure by opening a valve attached to the enclosure and allowing a compressed foam core within the enclosure to expand.

17. The pad of claim 1 wherein the fitting pad is attached to the under side of the protective gear such that the fitting pad is located to be worn substantially next to the body.

18. The pad of claim 1 wherein the impact absorbing layer substantially under lies the shell.

* * * * *

UNITED STATES PATENT AND TRADEMARK OFFICE

CERTIFICATE OF CORRECTION

PATENT NO. : 6,175,967 B1
DATED : January 23, 2001
INVENTOR(S) : Byron A. Donzis It is certified that error appears in the above-identified patent and that said Letters Patent is hereby corrected as shown below:

The inventor's address is incorrect. It should read:

RR 1, Box 139A
Hunt, Texas 78024

Signed and Sealed this

Twenty-ninth Day of January, 2002

*Attest:*

*Attesting Officer*

JAMES E. ROGAN
*Director of the United States Patent and Trademark Office*